United States Patent [19]

Gardner

[11] 4,366,126

[45] Dec. 28, 1982

[54] REMOVAL OF MOLYBDENUM FROM URANIUM SOLUTIONS

[75] Inventor: Harry E. Gardner, Grand Junction, Colo.

[73] Assignee: Union Carbide Corporation, Danbury, Conn.

[21] Appl. No.: 103,441

[22] Filed: Dec. 14, 1979

[51] Int. Cl.[3] ..... C01G 43/00

[52] U.S. Cl. ..... 423/7; 423/2; 423/17

[58] Field of Search ..... 423/2, 7, 17, 11

[56] References Cited

U.S. PATENT DOCUMENTS 4,092,399 5/1978 Narayan et al. ..... 423/2

OTHER PUBLICATIONS

Merritt, "The Extractive Metallurgy of Uranium", pp. 344–346, Colorado School of Mines (1971).

Bailar et al., "Comprehensive Inorganic Chemistry", vol. 3, pp. 707 & 738, Pergamon Press (1973) Oxford.

Qaim et al, *J. Inorg. Nuclear Chem.*, 30, 2279–2282 (1968).

Kroger, *Chem. Abs.*, 41, Abs. #5397c (1947).

Lukovnikov et al., *Chem. Abs.*, 57, Abs. #6684f (1962).

*Primary Examiner*—Edward A. Miller

*Attorney, Agent, or Firm*—John R. Doherty; James C. Arvantes

[57] ABSTRACT

Molybdenum is removed from a uranium bearing alkaline carbonate leach solution, by adding a compound which provides lead ion to react with the molybdenum present to form insoluble lead molybdate ($PbMoO_4$) which precipitates from the solution.

3 Claims, No Drawings

REMOVAL OF MOLYBDENUM FROM URANIUM SOLUTIONS

This invention relates to the refining of uranium and more particularly to the recovery of uranium from uranium bearing liquors containing molybdenum.

Some uranium ore occurs in deep sandy deposits of low concentration where direct mining is technically difficult and economically unfeasible. Such deposits can often be mined by a leaching technique wherein a solution of an alkaline carbonate such as ammonium carbonate or sodium carbonate containing an oxidant such as hydrogen peroxide is pumped down wells drilled into the uranium bearing formation. The oxidant renders the uranium soluble in the alkaline carbonate solution and the uranium enriched solution is them pumped back to the surface for recovery of the uranium by ion exchange or the like.

Economics dictate that the leach solution be recycled after recovery of the uranium and consequently various impurities accumulate in the recycled leach solution. The most pernicious of these impurities commonly encountered is molybdenum, which has been shown to accelerate the decomposition of hydrogen peroxide before it can be utilized in the leaching process. It is desirable therefore to remove the molybdenum from the leach solution without altering the composition of the alkaline carbonate and bicarbonate needed for the leaching process, and since molybdenum is a contaminant of the uranium product it is also desirable to separate the molybdenum from the uranium product. Until now there has been no proven method of removing molybdenum from solution without changing the chemical composition of the solution to the point where it could not be recycled to the leaching process.

It has now been discovered that a reactive lead compound which will furnish lead ion to the solution can be used to precipitate molybdenum from solution. The treatment can be applied to the alkaline carbonate leach solution of uranium contaminated with molybdenum as it is pumped from a recovery well and before it is fed into an ion exchange extraction column to remove the uranium. This removes the molybdenum from the leach liquor before it is recycled to the well and thus prevents the build up of molybdenum which would otherwise occur with resultant decomposition of the hydrogen peroxide used as an oxidant.

The removal of molybdenum from the uranium is important as a purification step even if a different oxidant, such as oxygen gas under pressure, is used which does not deteriorate in the presence of molybdenum in the same manner as hydrogen peroxide. Under these circumstances the lead ion precipitation process for the removal of molybdenum is better applied to the more concentrated solution of uranium and molybdenum obtained as eluate from the treatment of resin from the ion exchange process with an eluant such as ammonium chloride.

The reactive lead compound can be one selected from the group consisting of lead oxide, lead chloride, lead nitrate, lead acetate, lead sulphate, lead carbonate and lead hydroxide. Of these lead oxide is preferred. Lead oxide exists in several solid forms depending on the chemical and physical conditions under which it is prepared. Some forms are peculiar in that they are passive in contact with water and react very slowly with molybdate ions. Other forms, particularly the product commonly referred to as "Fumed" lead oxide is quite active chemically and reacts in a practical manner with molybdate ions. It is important that a chemically reactive form of lead oxide be employed for the present invention.

The lead compound added should provide at least 90 percent of the stoichiometric quantity of lead ion required to react with the molybdenum present to form the insoluble lead molybdate. When lead oxide is the lead compound employed it is preferred that at least one hundred percent of the stoichiometric quantity be present. Larger quantities will accelerate the reaction up to a point and it is within the skill of one versed in the art of ore purification to determine the optimum amount for a particular ore and lead compound. Temperature is not critical in the process of this invention. It is conveniently run at ambient temperature however temperature as low as freezing, 0° C., can be used as can be elevated temperatures which do not produce decomposition. The pH of the solution is not highly critical but is preferably maintained between 6 and 12. The solution should be agitated throughout the addition of the lead compound and the ongoing reaction.

The examples which follow illustrate embodiment of the invention but are not to be construed as limiting it to less than what is claimed.

EXAMPLE I

The sample treated consisted of two liters of leach liquor from a uranium recovery well. It contained 0.2 gram per liter of $U_3O_8$ and 0.2 gram per liter of molybdenum . Two grams of reactive lead oxide were added and the sample was agitated under ambient conditions for four hours and then filtered. The filtrate contained only 0.013 gram per liter of molybdenum. This removal of 85 percent of the molybdenum present was achieved with 215 percent of the stoichiometric amount of PbO required to react with all of the molybdenum present to form $PbMoO_4$.

EXAMPLE II

The sample treated in this example consisted of 100 ml. of eluate from an ion exchange column. It contained 5.6 grams per liter of $U_3O_8$ and 0.6 gram per liter of molybdenum. To the sample was added 0.2 grams of reactive lead oxide and it was then agitated for six hours under ambient conditions and then filtered. The filtrate contained only 0.0036 gram per liter of molybdenum. This removal 99.4 percent of the molybdenum present was achieved with 143 percent of the stoichiometric amount of PbO required to react with all of the molybdenum present to form $PbMoO_4$.

EXAMPLE III

In this example the process of the invention was evaluated in a continuous flow system. Three agitated beakers with overflow spouts were set up in series. The ion exchange eluate treated contained 0.42 weight percent $U_3O_8$, 0.091 percent molybdenum, 0.0011 percent $PO_4$ and 3.4 percent Cl, and had a pH of 8.4. The eluate was pumped continuously into the first beaker and allowed to flow through the other two. Reactive lead oxide was added to the first beaker every 15 minutes. Conditions and results for two runs are shown in tabular form. In run III a 150 percent of the stoichiometric amount of PbO required to react with all of the molybdenum present to form $PbMoO_4$ was added. The second and third stages, with 3.4 and 5.4 hour retention times, removed 97.6 and 99.5 percent of the molybdenum respectively. In run IIIb 130 percent of the stoichiometric amount of PbO was added. The flow rate was decreased and the agitation increased. In the three stages at respective retention times of 1.7, 3.1 and 6.5 hours the percentages of removal of molybdenum were 97.8 percent, 99.1 percent and 99.8 percent respectively.

TABLE

PART I

| Run No. | Eluate Flow ml/mm | PbO Added g/15 min | Operating Time hours | Eluate Volume liters | Total PbO grams |
|---|---|---|---|---|---|
| III a | 30 | 1.425 | 8.0 | 14.4 | 45.6 |
| III b | 25 | 1.038 | 7.0 | 10.5 | 29.1 |

TABLE

PART II

| Run | Cumulative Retention Time, hours | | | Filtrate % Mo | | |
|---|---|---|---|---|---|---|
| No. | 1 | 2 | 3 | 1 | 2 | 3 |
| III a | 1.42 | 3.42 | 5.38 | .0074 | .0022 | .0005 |
| III b | 1.71 | 4.11 | 6.46 | .0020 | .0008 | .0002 |

EXAMPLE IV

The sample treated consisted of 100 milliliters of leach liquor from a uranium recovery well. It contained 0.2 gram per liter of $U_3O_8$ and 0.2 gram per liter of molybdenum. A total of 0.168 gram of $PbCl_2$ was added and the sample was agitated under ambient conditions for two hours and then filtered. The filtrate contained only 0.0089 gram per liter of molybdenum. This removal of 95.5 percent of the molybdenum present was achieved with 276 percent of the stoichiometric amount of $PbCl_2$ required to react with all of the molybdenum present to form $PbMoO_4$.

EXAMPLE V

The sample treated consisted of 100 milliliters of leach liquor from a uranium recovery well. It contained 0.2 gram per liter of $U_3O_8$ and 0.2 gram per liter of molybdenum. A total of 0.5 gram of lead acetate was added and the sample was agitated under ambient conditions for sixteen hours and then filtered. The filtrate contained only 0.0076 gram per liter of molybdenum. This removal of 96.4 percent of the molybdenum present was achieved with 600 percent of the stoichiometric amount of lead acetate required to react with all of the molybdenum present to form $PbMoO_4$.

The lead oxide used in Example I was a A.C.P. grade reagent lead oxide obtained from the Baker Chemical Co. The lead oxide used in Examples II and III was a commercial grade fumed lead oxide obtained from the National Lead Co.

What is claimed is:

1. Method of recovering uranium from an alkaline carbonate leach solution containing uranium and molybdenum, which comprises:

(a) adding a reactive lead compound selected from the group consisting of lead oxide, lead chloride, lead nitrate, lead acetate, lead sulphate, lead carbonate and lead hydroxide, to said solution with agitation in an amount sufficient to supply at least 90 percent of the stoichiometric quantity of lead ion required to fully react with the molybdenum present to form insoluble lead molybdate;

(b) continuing the reaction with agitation until the concentration of molybdenum has been reduced to below about 0.013 gram molybdenum per liter of solution;

(c) filtering said solution to remove substantially all of the insoluble lead molybdate;

(d) recovering uranium from said solution by ion exchange extraction, and (e) recycling said solution for leaching additional uranium from uranium-bearing materials.

2. Method according to claim 1 wherein said alkaline carbonate solution is selected from the group consisting of ammonium carbonate and sodium carbonate.

3. Method according to claim 2 wherein said reactive lead compound is lead oxide.

* * * * *

UNITED STATES PATENT AND TRADEMARK OFFICE

CERTIFICATE OF CORRECTION

PATENT NO. : 4,366,126

DATED : December 28, 1982

INVENTOR(S) : Harry E. Gardner

It is certified that error appears in the above-identified patent and that said Letters Patent is hereby corrected as shown below:

On the title page, the title should read:

-- Recovery Of Uranium From Uranium Bearing Solutions Containing Molybdenum --.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*